United States Patent [19]

Tuson

[11] 4,231,682

[45] Nov. 4, 1980

[54] DEVICE FOR HANDLING APPLIANCES ON A SEA BED

[75] Inventor: Samuel Tuson, Mesnil-le-Roi, France

[73] Assignee: Entreprise d'Equipements Mecaniques et Hydrauliques E.M.H., France

[21] Appl. No.: 868,300

[22] Filed: Jan. 10, 1978

[30] Foreign Application Priority Data

Jan. 17, 1977 [FR] France ..... 77 01241

[51] Int. Cl.[2] ..... E02B 17/00

[52] U.S. Cl. ..... 405/202; 166/366

[58] Field of Search ..... 61/95, 93, 87, 53.5; 175/7, 9; 166/0.5; 405/224, 226, 201, 203, 202, 232

[56] References Cited

U.S. PATENT DOCUMENTS

| | | | |
|---|---|---|---|
| 2,628,818 | 2/1953 | Graham | 175/9 |
| 3,004,612 | 10/1961 | Kofahl | 175/9 X |
| 3,636,716 | 1/1972 | Castellanos | 61/95 |
| 3,677,016 | 7/1972 | Garrigus | 61/95 |
| 3,685,300 | 8/1972 | Mott et al. | 175/9 X |
| 3,789,921 | 2/1974 | DeChassy et al. | 166/0.5 |
| 3,815,371 | 6/1974 | Kohler | 61/53.5 X |
| 4,058,137 | 11/1977 | De St Palais et al. | 61/95 X |

*Primary Examiner*—David H. Corbin

*Attorney, Agent, or Firm*—Steinberg and Blake

[57] ABSTRACT

A method of handling appliances on a sea bottom for the operation and maintenance of well heads in offshore oil field or other working plants making use of an articulated column resting on the sea bed substantially about the site of said appliances or well heads, wherein the improvement consists in the use of at least one tubular elongated structure extending along said column in parallel relation to the axis thereof, the inside of said structure serving the purpose of guiding said appliances and related means cooperating therewith and also of forming a passage-way for the remote control cables and other transmission or connecting means in particular for operating the well heads.

3 Claims, 4 Drawing Figures

DEVICE FOR HANDLING APPLIANCES ON A SEA BED

The present invention relates essentially to a method of and an arrangement for handling appliances or devices on a sea bed or like submarine floor in particular for the installation and maintenance or servicing of the well heads in off-shore (oil, gas etc.)-field working plants comprising an articulated column, oscillating tower or like compliant platform resting on the sea bed substantially at the location of said well heads and a main object of the invention is to adapt such articulated columns to new uses in particular for the servicing and maintenance of wells drilled on deep water sites.

According to the U.S. patent application Ser. No. 802,051 in order to provide for the maintenance and servicing of at least one well head or as assumed hereinafter of several well heads arranged for instance in cluster-like configuration on an underwater base member to which are leading a plurality of wells clustered for instance about a central axis, it has been suggested to make use of a platform or column bearing upon and in particular pivotally connected to said base member and fitted with means to provide for the guidance, along said column, of hoisting apparatus for lifting the well head or heads and all the means or units cooperating therewith, through the agency of upright or substantially vertically extending rails, tracks or like runways.

The present invention still complies with that general definition but instead of performing the guidance of said appliances and units cooperating therewith in an essentially external manner, there is now provided for accomplishing maintenance and servicing of one or several well heads, at least one tubular substantially elongated structure extending along the column in parallel relation to the center-line axis thereof and inside of which structure is effected the guidance of said appliances as well as of all units cooperating therewith, said structure forming also a passage-way for remote-control cables and other transmission or connecting means, in particular for operating the well heads.

Thus is achieved a significant simplification of the construction of the column and additional special relatively complicated arrangements for lowering or raising the remote-control cables are no longer required and may be dispensed with since the remote-control cables as well as the tools and implements for the maintenance, servicing and measuring of the wells or in other words for so-called workover and wireline operations may be caused to extend or to be moved through said tubular structure.

A process such as defined hereinabove may be used in different manners and in particular according to a first embodiment with a platform, in particular an articulated column pivotally connected to an underwater base member and comprising standards, uprights or like pillars connecting the top or upper deck of the column to the submarine base member, said process being characterized in that at least one of said pillars and preferably each one thereof is designed as a tubular structure for guiding said appliances.

In such a case each pillar constructed as a tubular structure for guiding said appliances and in particular the well heads will of course open in front of one of the wells so that all the wells may be serviced in the same manner.

According to this embodiment the top or upper portion of the column forming the column head may be rotatably mounted to revolve or swivel about the longitudinal center-line or axis of a column so that said column head may carry one single derrick, outfit or like rigging only which may be successively brought through stepwise turning of the rotary column head into alignment with each tubular structure.

According to another embodiment of the invention this method may also be used with a platform, in particular an articulated column pivotally connected to a submarine base member and again comprising standards, uprights or like pillars interconnecting the head or top deck of the column with the submarine base member and is characterized in that said tubular structure for guiding said appliances is mounted on a rotary head of the column and is made fast with at least one carriage, trolley or like runner adapted to be guided by a guide rail or like track-way extending around the column so that it may be caused by turning said rotary head step by step to come in front of the boreholes of several wells, successively.

Such an embodiment differs from the foregoing one described hereinabove and that it makes use of one single tubular guiding structure only for servicing a plurality of wells since upon revolving step by step about the column while remaining parallel to the longitudinal axis of the latter it may successively be moved into substantially registering alignment with each one of the wells.

The invention will be better understood and further objects, characterizing features, details and advantages thereof will appear more clearly as the following explanatory description proceeds with reference to the accompanying diagrammatic drawings given by way of non limiting examples only illustrating two specific presently preferred embodiments of the invention and wherein.

Figure 1:
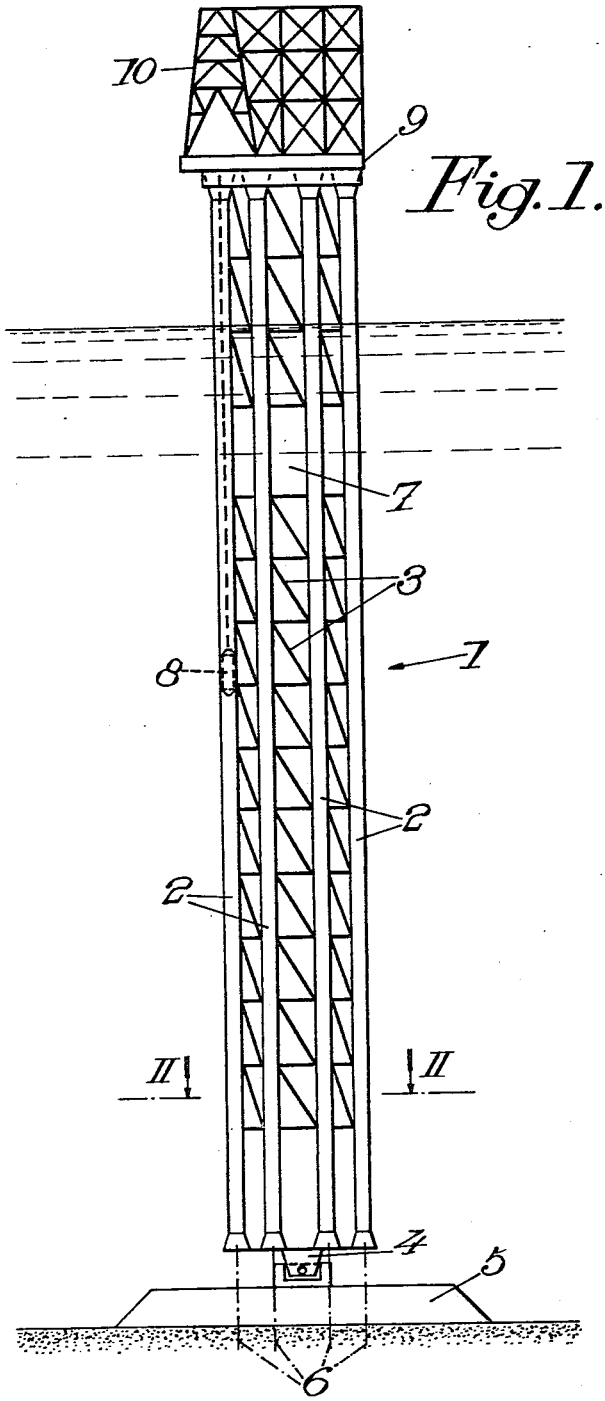
FIG. 1 is an elevational view in partial longitudinal section of a column according to a first embodiment of the invention.
Figure 2:
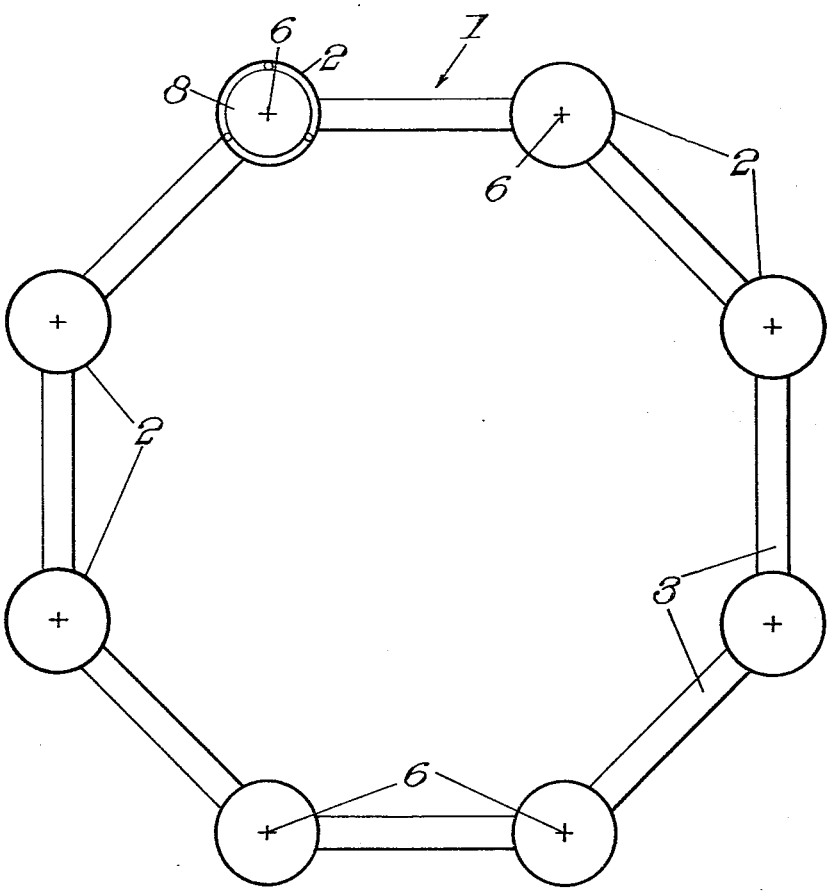
FIG. 2 is a view in cross section taken upon the line II—II of FIG. 1.

Referring to FIGS. 1 and 2 there is diagrammatically shown and generally designated by the reference numeral 1 a column consisting of longitudinal structural members forming standards, uprights or like pillars 2 for instance eight in number braced or interconnected by a lattice-work structure 3, that column being pivotally connected by means of a so-called universal mechanical Cardan joint coupling shown at 4 onto a submarine base member 5 resting on the sea bed. The various oil or gas producing wells to be serviced which are positioned substantially flush with the upper surface of the base member have been shown symbolically only by means of their center-line axes 6. The column 1 carries a main float or like buoyant body 7 arranged near and underneath the water surface of sea-level. Such a construction is already well known in the prior art so that it needs not be described with more details.

In this first embodiment each one of the eight uprights or pillars 2 of the column 1 consists of a tubular guide structure in which may be inserted and guided, for servicing each one of the eight wells 6, a well head such as the well head diagrammatically shown at 8, each pillar 2 being of course substantially centered in aligned registering relationship over one of the wells. It is thus possible to conveniently proceed with the handling and maintenance of the heads 8 of the wells 6. Moreover each pillar 2 designed as a tubular guide structure may at the same time be used as a protecting and guiding sheath or casing for the remote-control cables for handling or operating the corresponding well head 8 as well as for the auxiliary units, tools and implements such as those used in workover or wireline or other operations (not shown).

In this first embodiment the column 1 should advantageously be provided with a rotary column head 9 so that a derrick or rigging 10 and any accessory or subsidiary plant carried by the rotary head 9 may come into alignment with one given pillar 2 upon turning said rotary head step by step.

Figure 3:
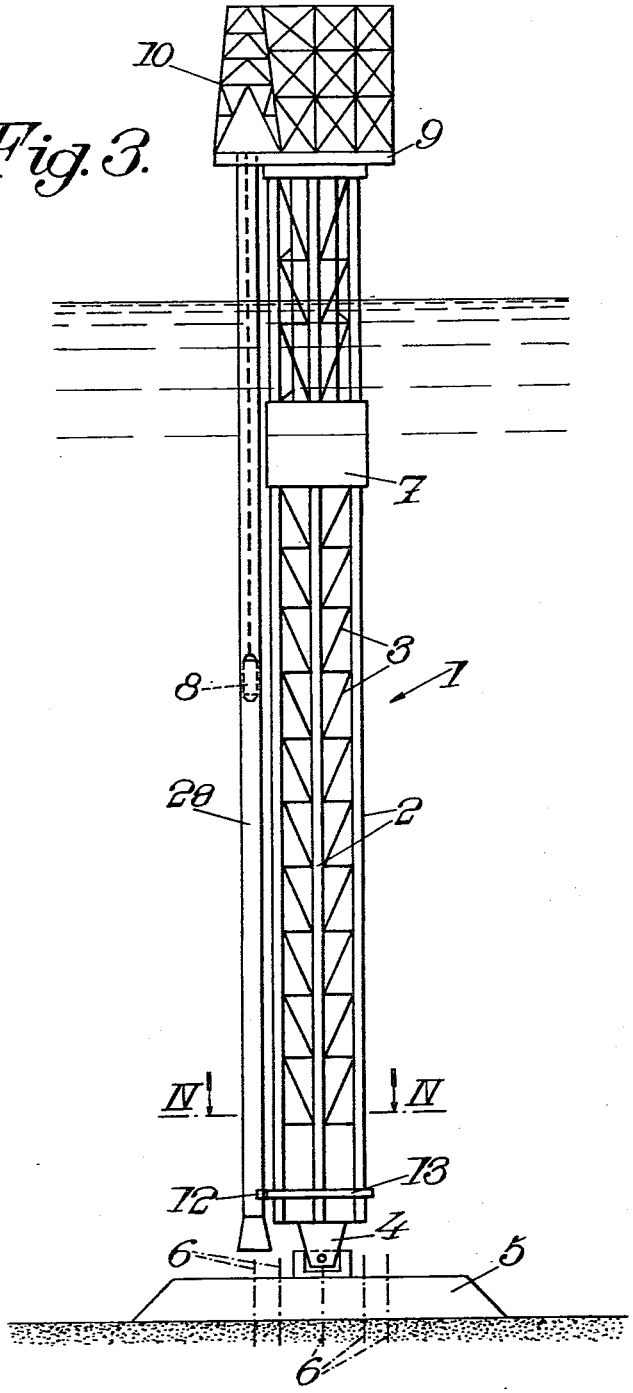
FIG. 3 is an elevational view in partial longitudinal section showing a column according to a second embodiment of the invention.
Figure 4:
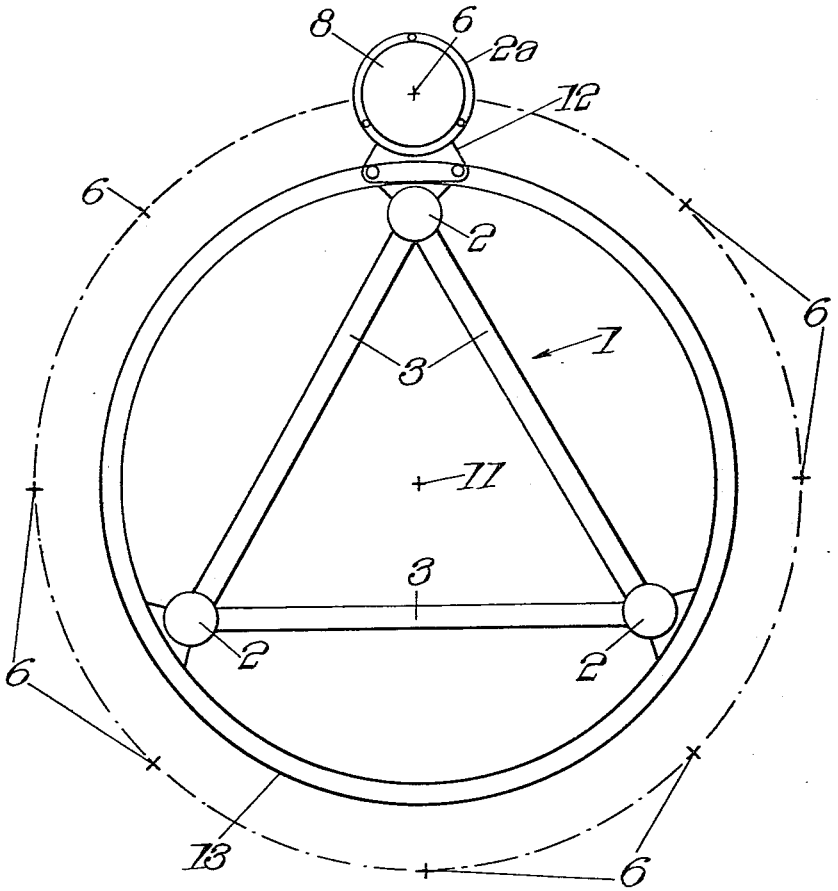
FIG. 4 is a view in cross section taken upon the line IV—IV of FIG. 3.

Referring to FIGS. 3 and 4 which illustrate a second embodiment of the invention the same reference numerals as in FIGS. 1 and 2 have been used to designate the same or like component parts or elements as those of the first embodiment disclosed hereinabove.

The column 1 is again designed for servicing eight wells centered at 6 and for instance equally spaced from each other and from the longitudinal center-line axis 11 of the column. In this case, however, the servicing column 1 may comprise a smaller number of pillars or standards such as for instance three pillars 2 only.

According to this second embodiment of the invention there is provided for handling and guiding the well heads 8 and their accessory parts, one single and same tubular structure 2*a* which will perform quite the same function as the pillars 2 in FIGS. 1 and 2, said single tubular structure being mounted on the rotary column head 9 and adapted to revolve about the column while remaining parallel to the longitudinal center-line axis 11 of the column.

At least adjacent to its lower end this tubular structure 2*a* is rigidly connected to a carriage 12 riding on and guided by a circular rail or runway 13 secured to the bottom portion of the column 1.

This rail has of course such a position as to keep the longitudinal center-line axis of the guiding structure 2*a* at the same distance from the longitudinal center-line axis 11 of the column as the wells 6. Thus a step-wise rotation by one eighth of a revolution of the rotary column head 9 and accordingly of the guide structure 2*a*, operated for instance by means of a hydraulic power control system will thus allow to perform the handling and the maintenance or servicing of the eight well heads 6. As in the foregoing case the tubular structure 2*a* will of course also provide for the guiding and protection of the tools and implements used for maintenance or servicing operations such as workover or wire-line operations as well as for moving a diving bell therethrough.

It is to be understood that the invention should not be construed as limited to those embodiments thereof which have more especially been contemplated but as encompassing all the alternatives and modifications thereof.

Thus it could be contemplated for instance to combine both embodiments disclosed hereinabove. Thus referring again to FIGS. 3 and 4 if tubular structures 2 are also provided there, such structures may be used for the handling and guidance of three other well heads concurrently with the use of the structure 2*a*.

What is claimed is:

1. An articulated column structure having a longitudinally extending axis adapted to be pivotally connected to an underwater base member anchored to the sea bed and adapted for the handling and maintenance of well heads in off-shore oil fields or the like, said column structure comprising: a head portion defining a top deck of said column structure; a bottom portion adapted to be pivotally connected to said base member anchored to the sea bed; a plurality of pillar members interconnecting said head portion and said bottom portion extending substantially parallel to the axis of said column structure; at least one tubular member mounted for rotation around said longitudinally extending axis adapted for being brought into substantial axial alignment with successive ones of a plurality of wells provided in the base member; means for rotating said tubular member; and means for guiding well head maintenance and servicing appliances through said tubular member between said head portion and said successive ones of the plurality of wells.

2. A column structure according to claim 1 wherein said at least one tubular member is mounted outside of said column structure.

3. An articulated column structure having a longitudinally extending axis adapted to be pivotally connected to an underwater base member anchored to the sea bed and having a plurality of wells and adapted for the handling and maintenance of well heads in off-shore oil fields or the like comprising: a head portion defining a top deck of said column structure, a bottom portion adapted to be pivotally connected to said base member; a plurality of pillar members interconnecting said head and bottom portions, said head portion comprising a member which is rotatably mounted for rotation around said longitudinal axis; at least one tubular member mounted for rotation around said longitudinal axis adapted for being brought into substantial axial alignment with successive ones of a plurality of wells provided in the base member; track means encircling said column structure at a lower portion thereof having a carriage means mounted therein for movement therearound; said at least one tubular member being secured at its upper end to said rotary head portion member for rotation therewith and at its lower end to said carriage means mounted for movement in said track means; means for rotating said rotary head portion member; and means for guiding well head maintenance and servicing appliances through at least one tubular member between said head portion and said successive ones of the plurality of wells.

* * * * *